United States Patent [19]

Dummermuth et al.

[11] Patent Number: 4,723,610

[45] **Date of Patent: * Feb. 9, 1988**

[54] PERCUSSION DEVICE

[75] Inventors: Paul Dummermuth, Zunzgen; Jean-Pierre Budliger, Onex, both of Switzerland

[73] Assignee: Von Arx AG, Sissach, Switzerland

[ * ] Notice: The portion of the term of this patent subsequent to Dec. 23, 2003 has been disclaimed.

[21] Appl. No.: 910,799

[22] Filed: Sep. 22, 1986

Related U.S. Application Data

[63] Continuation of Ser. No. 695,462, Jan. 28, 1985, abandoned.

[30] Foreign Application Priority Data

Feb. 9, 1984 [CH] Switzerland ..... 605/84

[51] Int. Cl.[4] ..... B25D 17/24

[52] U.S. Cl. ..... 173/1; 173/101; 173/162 R; 29/81 D

[58] Field of Search ..... 173/51, 139, 162; 384/15, 16, 138, 151, 153; 29/81 D

[56] References Cited

U.S. PATENT DOCUMENTS

| | | | |
|---|---|---|---|
| 2,392,182 | 1/1946 | Payne | 277/171 |
| 2,638,749 | 5/1953 | Sparano | 173/139 X |
| 3,032,998 | 5/1962 | Atkinson | 173/139 |
| 3,094,900 | 6/1963 | Wandel et al. | 173/139 X |
| 3,496,840 | 2/1970 | Wandel et al. | 173/139 X |
| 3,601,205 | 8/1971 | Kurt | 173/DIG. 2 X |
| 4,134,193 | 1/1979 | Lenzin et al. | 29/81 L |
| 4,602,689 | 7/1986 | Wauner | 173/139 |
| 4,630,687 | 12/1986 | Dummermuth | 173/51 |

*Primary Examiner*—Paul A. Bell
*Assistant Examiner*—James L. Wolfe
*Attorney, Agent, or Firm*—Karl F. Ross; Herbert Dubno

[57] ABSTRACT

The percussion mechanism of this device, comprising a cylinder, a free piston, an anvil, a tool holder in which a bundle of needles is disposed, the heads of which are applied to the anvil, is mounted to slide in a tubular housing between two springs used to insulate dynamically the percussion mechanism of the housing and of the handle which holds it. The cylinder is mounted in the housing by a suspension comprising two annular seals and the cylinder is set with a clearance so that the centering provided by the seals insulates mechanically the cylinder of the housing and reduces the transmission of vibrations.

6 Claims, 7 Drawing Figures

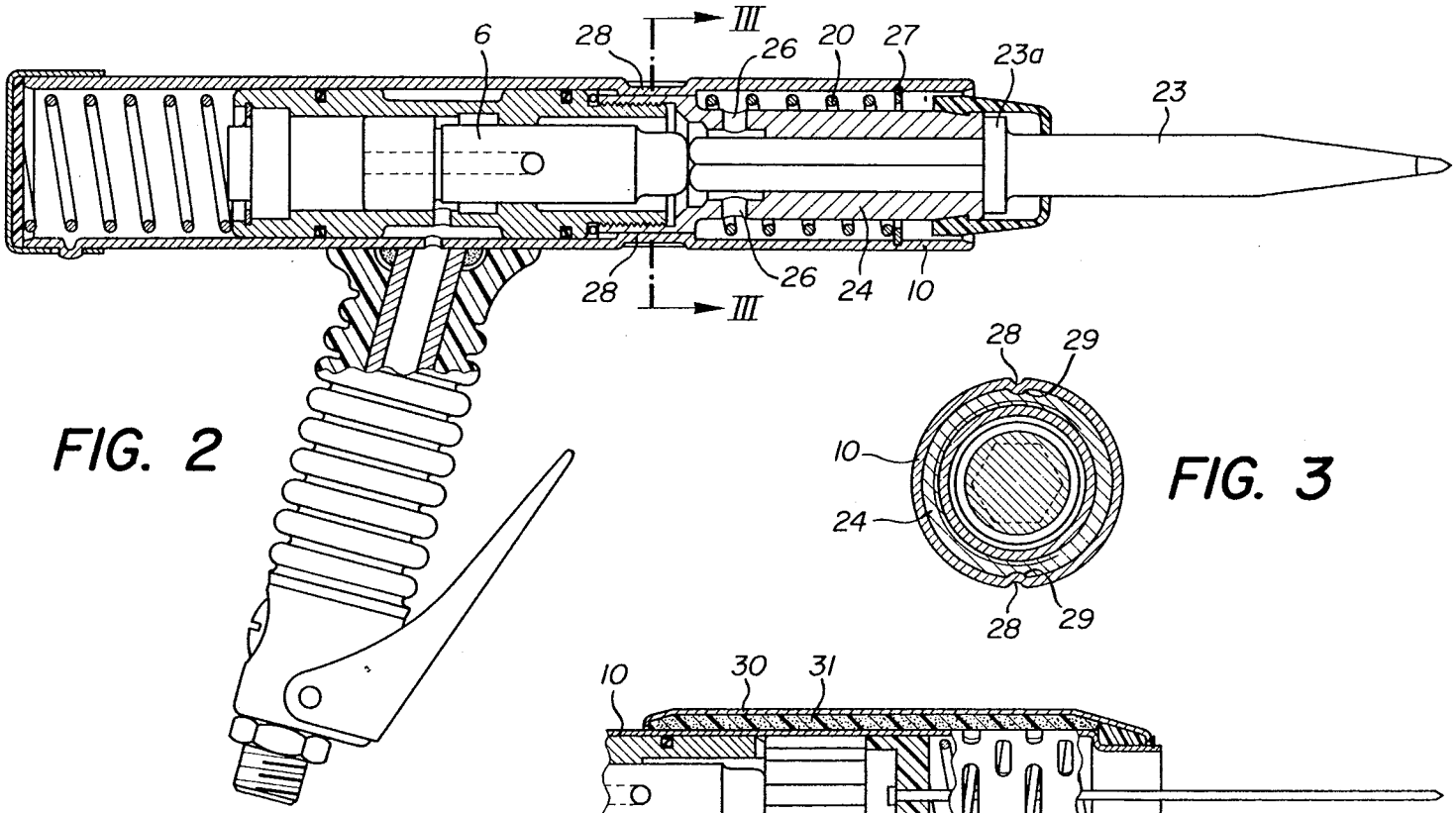
FIG. 2
FIG. 3
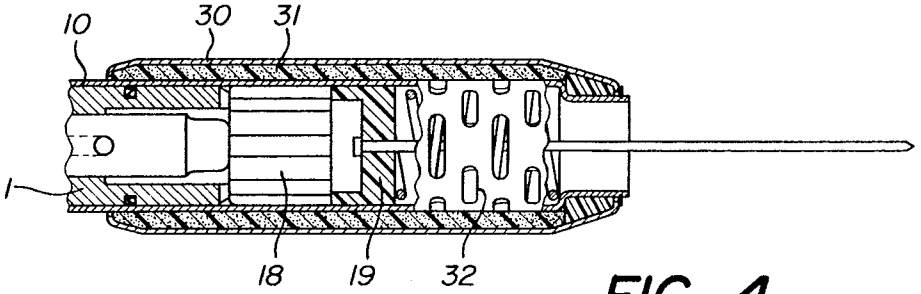
FIG. 4

PERCUSSION DEVICE

This is a continuation of application Ser. No. 695,462, filed on Jan. 28, 1985, now abandoned.

FIELD OF THE INVENTION

The present invention relates to a percussion device comprising an elongate housing, at the front end of which a tool such as a bundle of metal needles projects axially, a tool holder mounted to slide longitudinally inside the housing, a cylinder mounted to slide longitudinally inside the housing and the front end of which acts as a rear abutment for the tool or anvil and is open to permit the axial passage of a free piston mounted inside the cylinder and acting as a percussion member, drive means to initiate and maintain a series of percussions of the percussion member against the tool anvil at a given frequency, a resilient compression component disposed between the respective rear ends of the housing and the cylinder, and a resilient compression component acting between the front end of the housing and the cylinder, via the anvil if present.

BACKGROUND OF THE INVENTION

Devices of this type are used for cleaning surfaces and to this end comprise a bundle of metal needles. Other devices of the same type comprise a cutter and are used for example to eliminate the welding seam which projects at the junction of two parts, to eliminate excess material at the seam, etc. Extended use of these devices is difficult because of the noise and on account of the vibrations of the device.

Another type of percussion device is known which has no anvil or free piston, but two co-axial pistons pressed against one another by two springs moving towards and away from one another alternately under the action of a pneumatic drive mechanism. A device of this type is relatively quiet, but is limited to low power and its output in relation to the volume of compressed air consumed is very poor. In view of their low power, these devices cannot be used for operations such as cleaning rusted metal sheets or working on concrete surfaces.

It has already been proposed to reduce vibrations produced by percussion tools, in particular vibrations transmitted to the housing and gripping members of the tool and which result in increased fatigue for the operator and thus in lower performance during extended use. This is the case in particular in French Pat. No. 1 059 349, in which a cylinder is mounted to slide longitudinally between two springs in a housing rigid with a handle. A mounting sliding longitudinally between two springs is also disclosed in French Pat. No. 1 154 429 and U.S. Pat. No. 3,788,404. This spring mount effective in the longitudinal direction of the percussion mechanism in the housing should normally permit a quite considerable damping effect of the vibrations to be obtained insofar as as the free piston of the percussion mechanism moves longitudinally. However, vibrations are transmitted to the housing by all the contact surfaces, in particular by the guide surfaces of the slide mechanism in the housing. Guiding must be carried out with sufficient precision, in the absence of which wear between the moving parts increases rapidly and results moreover in heating and expansion of the housing which thus rapidly becomes inoperative.

The spring mount of the above-mentioned solutions is furthermore limited to pneumatic tools supplied axially with compressed air via the rear end. This method of supply is not suitable for small manual devices such as pneumatic needle or cutter guns. These devices are provided with a lateral handle, hence the title "gun", and it is therefore much more practical to supply the striking mechanism laterally via the handle. However, the lateral supply presupposes perfect sealing between the housing and the striking mechanism which necessitates close contact between the mechanism which produces vibrations and the housing.

OBJECTS OF THE INVENTION

The object of the present invention is to provide improved percussion tool for the purposes described which will effectively reduce vibrations transmitted to the housing in this type of device, while maintaining in particular the convenience of the lateral supply of compressed air via the handle.

SUMMARY OF THE INVENTION

To this end, the present invention in one aspect provides a percussion device comprising an elongate housing having an open front end, a bundle of metal needles which projects axially from the front end, a needle holder mounted to slide longitudinally inside the housing, an anvil in the housing adjacent the needle holder, a spring to press the needle holder resiliently against the anvil, a cylinder mounted to slide longitudinally inside the housing and having an open front end which acts as a rear abutment for the anvil, a free piston mounted slidably in the cylinder and extending axially through the open front end and acting as a percussion member, drive means to initiate and maintain a series of percussions of the percussion member against the anvil at a given frequency, and a resilient compression component disposed between respective rear ends of the housing and the cylinder. According to the invention the diameter of the cylinder is selected so as to provide a circumferential clearance between the cylinder and the housing, and two resilient annular bearings are provided, spaced longitudinally from one another, and interposed between the cylinder and the housing to guide the cylinder co-axially in the housing and to act as a suspension between the cylinder and housing.

In accordance with another aspect of the invention there is a percussion device comprising an elongate housing having an open front end, a tool holder mounted to said open front end for slidably receiving a tool which projects axially and is mounted to slide longitudinally in the tool holder, a cylinder mounted to slide longitudinally inside the housing and having an open front end which is adjacent to the tool holder, a free piston which is mounted slidably in the cylinder, which extends axially through the open front end thereof, and which acts as a percussion member for the tool, drive means to start up and maintain a series of percussions of the percussion device against the tool at a given frequency, and two resilient compression components disposed at respective ends of the housing and exerting opposing forces on the cylinder. According to this aspect of the invention, the diameter of the cylinder is selected so as to provide a circumferential clearance between the cylinder and the housing, and two resilient annular bearings are provided, spaced longitudinally from one another, and interposed between the cylinder and the housing to guide the cylinder co-axially in the housing and to act as a suspension between the cylinder and housing.

The advantage of the present device lies in a considerable damping of vibrations. The steps taken to increase the damping do not entail either expensive modifications to the device or complicated construction or operation. The solution according to the invention has practically no adverse effect on the drive mechanism and thus does not reduce the initial power of the device, in contrast with what has been proposed in the case of devices in which the tool is rigid with a reciprocating piston.

BRIEF DESCRIPTION OF THE DRAWING

Other advantages will become apparent in the light of the following description and the attached drawing which illustrates diagrammatically, and by way of example, embodiments of the device which is the subject of the invention. In the drawing:

FIG. 2 is a similar view of a second embodiment;

FIG. 3 is a cross section along line III—III of FIG. 2;

FIG. 4 is a partial longitudinal section of a modification of FIG. 1;

SPECIFIC DESCRIPTION

Figures 1, 5:
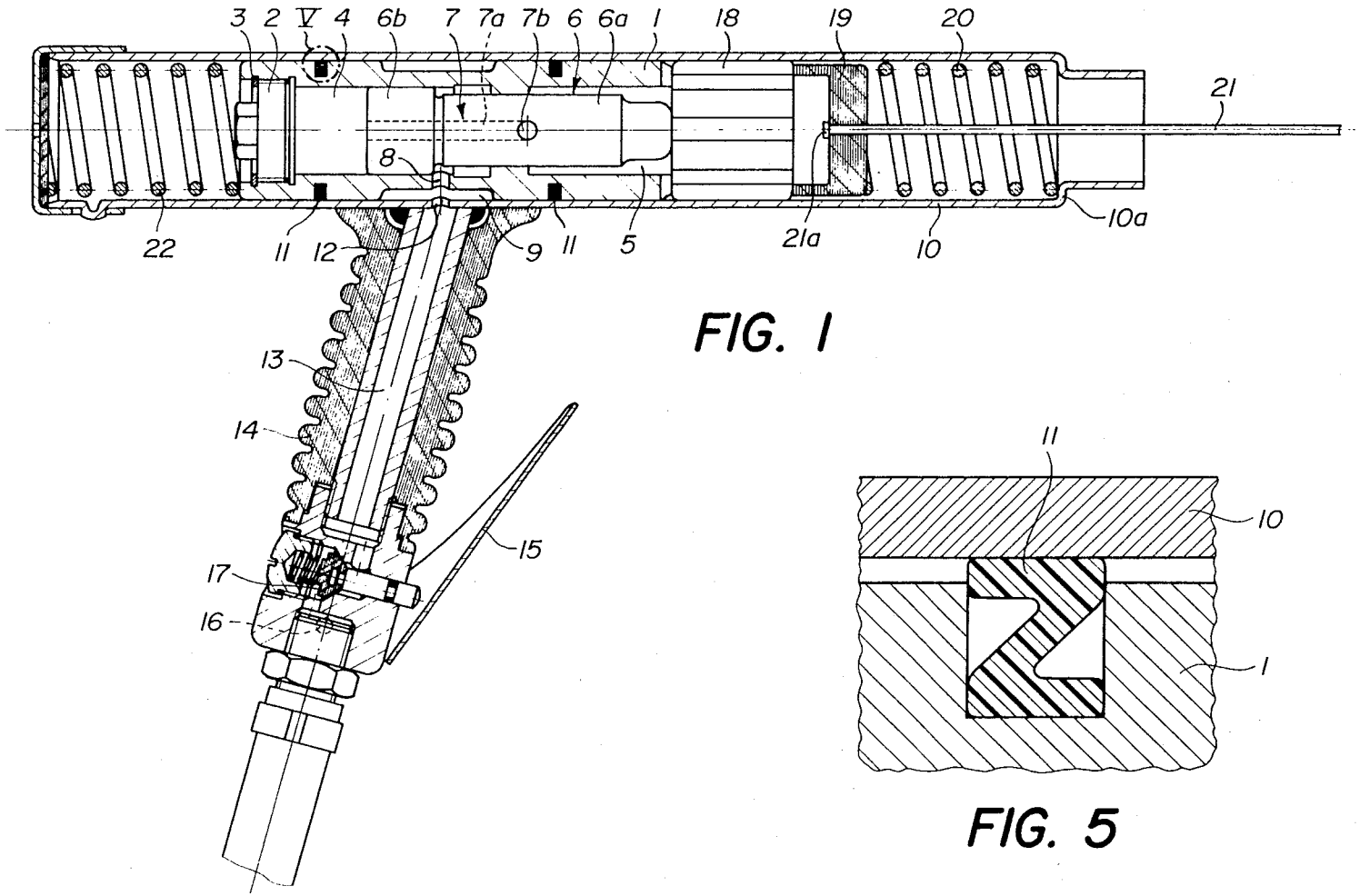
FIG. 1 is an axial section through a first embodiment.
FIG. 5 is a greatly enlarged view of the detail in the dot-and-dash circle V of FIG. 1.

The device illustrated in FIG. 1 comprises a cylinder 1 the front end of which is open and the rear end of which is closed by a plug 2 held in place by a spring ring 3. The cylinder 1 forms two compartments 4 and 5. A free piston 6 having a front section **6*a* of small diameter and a section 6*b* of large diameter is mounted to slide inside the cylinder 1. It comprises a T-shaped passage 7 having an axial part 7*a* extending from the rear end of the free piston 6 to a diametral part 7*b*. An aperture 8 connects the compartment 4 of the cylinder 1 to an annular groove 9 in the piston surface forming an annular space disposed between the cylinder 1 and a housing 10 in which the cylinder 1 is mounted to slide axially. The annular groove 9 in the piston surface is sealed by means of two annular seals 11 disposed in the cylinder 1 at both ends of the annular space defined by the groove 9. Another aperture 12 in the wall of the housing 10 is used to connect the annular space of the groove 9 to a supply duct 13 passing longitudinally through a handle 14 fixed laterally to the housing 10 and giving the device the appearance of a gun. The supply duct 13 is adapted to be connected to a compressed air supply (not shown). A lever 15 articulated about a transverse axis 16 on the handle 14 controls the opening and closing of a valve 17 controlling the supply duct 13**.

The open front end of the cylinder 1 is in contact with an anvil 18 against the front end of which a tool holder 19 is pressed by a spring 20 which bears axially forward against a reduced diameter part **10*a* of the housing 10. The tool holder 19 supports a bundle of needles 21, of which only one needle is shown, for cleaning surfaces. The needles 21 extend slidably through the tool holder 19 and have heads 21*a* for making contact with the front face of the anvil 18** when the tool is placed against a surface to be worked on.

The rear end of the cylinder 1 is acted upon by a spring 22 compressed between the cylinder and the rear end of the housing 10.

In order to reduce the transmission of vibrations to the housing 10, the diameter of the cylinder 1 is dimensioned in such a way as to be set in the housing with sufficient clearance so that there is no contact between the cylinder 1 and the housing 10 (see FIG. 5). In this example the clearance is 0.2 mm on the diameter. The centering of the cylinder 1 and its suspension in the housing are provided by the seals 11, which thus have two functions. To this end, the seals have a Z-shaped cross section so as to make the suspension of the cylinder sufficiently resilient and to provide maximum damping of the vibrations transmitted to the housing 10. A greatly enlarged partial cut-away detail view of the resilient suspension of the cylinder 1 in the housing 10 is shown in FIG. 5. Since the housing and the cylinder are separated from one another, the internal surface of the housing 10 does not need to be treated by hardening, which reduces production costs. Among the advantages of this embodiment it should also be noted that it is particularly well-suited to the lateral supply of compressed air, which is the most inexpensive solution. In addition to this and by contrast with an axial supply, the cylinder 1 and the supply duct 13 have no mechanical connection so that the cylinder cannot be subject to biasing, forming an angle with the longitudinal axis of the device, as occurs with axial supply when the supply duct is offset.

It should also be pointed out that the needle holder 19 is made preferably of a plastics material as described in U.S. Pat. No. 4,134,193, while the surface of the anvil 18 in contact with the housing 10 is likewise made preferably of a plastics material as described in copending application Ser. No. 667,281 filed Nov. 1, 1984 and based upon a Swiss application No. 5962/83-0 filed Nov. 4, 1983. Consequently, the housing is not in contact with any metal part of the percussion mechanism.

When the device is in use, the front end of the needles 21 is applied to the surface to be worked, so that their heads **21*a* come into contact with the front face of the anvil 18. The spring 22 is compressed to a greater or lesser degree, depending on the pressure exerted. When the valve 17 controlling the supply duct 13 is opened by depressing the lever 15 against the handle 14, the compressed air is directed into the compartment 4 of the cylinder 1. By means of the T-shaped duct 7, the air is directed between the rear face of the free piston 6 and the plug 2 from the rear end of the compartment 4. The free piston 6 then moves forward toward the anvil 18 and strikes the rear portion of same. In this position, the rear portion of the compartment 4 is no longer in contact with the compressed air supply, but the compartment 5 is open toward the front so that the compressed air in the rear compartment 4 can escape. Since the front portion of the compartment 4, comprising an annular space disposed around the front section of small diameter 6*a* of the free piston 6, remains connected to the compressed air supply, the pressure increases in this annular space and moves the piston 6** backward, after which the cycle starts again.

As has been stated, the presence of the spring 22 in no way adversely affects the operation of the free piston drive mechanism. The spring 22 is compressed as a function of the pressure exerted in pressing one or more tools 21 axially forward against the surface to be worked. On the other hand, vibrations due to the impact of the free piston 6 against the anvil 18 and that of the tools 21 against the work surface are absorbed by the springs 20 and 22 between which the mechanism unit is mounted in the housing 10. Furthermore, the absence of any rigid connection between the striking mechanism and the housing 10 means that there is practically no transmission of vibrations to the housing 10 and to the handle 14, thereby reducing considerably user fatigue, without materially reducing the performance of the device. This improvement does not, moreover, bring about a noticeable increase in the retail price, of the tool since it only requires one additional spring, the cost of which is compensated for by the cost saving achieved because the interior of the housing 10 does not need to be hardened.

The modification illustrated in FIG. 2 relates to a single tool device comprising a cutter 23 and a percussion mechanism identical to that in FIG. 1 and which will therefore not be described. In this embodiment, the cutter 23 is directly in contact with the free piston 6. The square or hexagon section rear portion is mounted so that is slides in a guide member 24 secured at the front end of the cylinder 1 and the cutter 23 is held by means of a cup hooked to the front end of the guide member 24 and to a collar 23*a* disposed on the cutter 23. The guide member 24 also has two apertures 26 for the air leaving the cylinder 1 to escape. The front end of the spring 20 bears axially forward against a ring 27 fixed in the housing 10. Finally, in order to prevent the mechanism from revolving in the housing 10, the latter has two pressed projections 28 which co-operate with two grooves 29 of the guide member 24, as shown in particular in FIG. 3. Apart from these features, this device is similar to that in FIG. 1 both in design and operation. The description relating to FIG. 1 should thus be referred to in order to understand the mechanism unit and its operation.

The modification illustrated in FIG. 4 is a device whose housing 10 is surrounded on part of its length by a tubular member 30. A sound proofing material, such as plastics foam 31, in particular a polyurethane foam, fills the space between the tubular parts and is in contact with the interior of the housing by means of apertures 32. The sound insulating housing makes it possible to damp parasitic vibrations which might occur in the area of the anvil 18 and the needle holder 19. Vibrations of this type result from non-longitudinal components produced consequent on the striking action of the free piston 6 on the anvil 18. A sound insulating tubular part of this type thus complements the action of the damping springs and the suspension of the cylinder 1 and reduces further the level of residual vibrations and reduces the effect of noise produced by the repeated impact of the free piston on the anvil 18.

Figure 6:
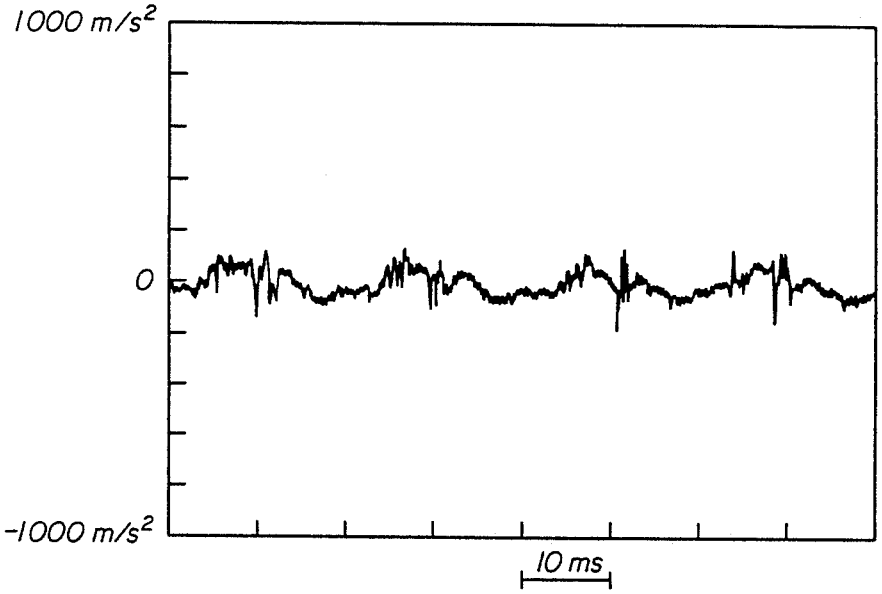
FIGS. 6 and 7 are two acceleration diagrams.
Figure 7:
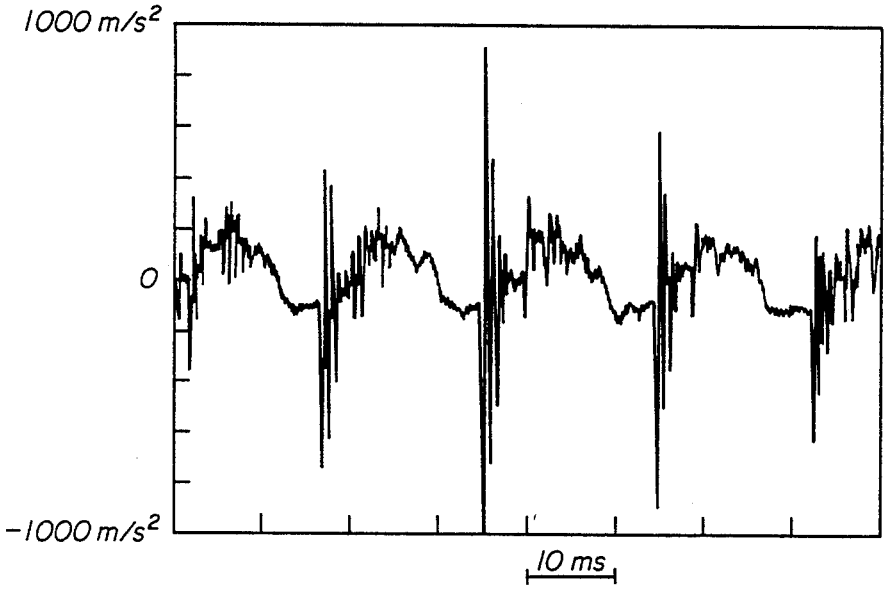

The device which is the subject of the invention was subjected to a series of comparative tests at the "Laboratoire Fédéral d'essai des matériaux et institut de recherche" (Federal laboratory for testing materials and research institute) at Dübendorf (Switzerland), and at the "Institut für Hygiene und Arbeitsphysiologie" (Institute for Hygiene and Work Physiology) of the Ecole polytechnique fédéral à Zürich (Zurich federal polytechnic school). The tests involved, on the one hand, comparative acceleration measurements and, on the other hand, physiological tests relating to the effects of different devices, including the subject of the invention, on individuals who were not informed of the nature of the tests in which they were taking part, in order to avoid being affected by psychological factors. FIGS. 6 and 7 represent two diagrams of accelerations measured in the band 3 Hz to 1000 Hz, respectively on the device which is the subject of the invention, and on an identical device but without resilient suspensions.

The physiological tests were carried out with the aid of the device which is the subject of the invention and three other devices all of the needle gun type, one of the devices used for comparative purposes being sold commercially by the proprietor of the invention and two others being sold by other manufacturers.

The tests were concerned with the acceleration of heart beat, consequent on using the devices, which involves an increase of approximately 35 beats/min. for the three comparative devices, whereas the acceleration is 25 beats in the case of the device which is the subject of the invention. The tests were carried out with aural protection from noise in all cases, without this protection a uniform further increase of 15 extra beats is recorded.

The increase is surface temperature at the tips of the fingers after using the device was also measured. It is 3°–4° C. for the three comparative devices and 2° C. for the device according to the invention.

The force required by the flexor muscles of the hand was recorded by the electrical activity of these muscles which is a linear function of the force produced. It was recorded that in the case of the device according to the invention, this force represents only 80% of the force required in the case of the lightest of the three comparative devices which is even lighter than the device according to the invention (3.070 kg as against 3.220 kg respectively).

Another test carried out was the increase in reflex time of the the biceps after work, whereas this increase is 3 ms in the case of the device according to the invention, it is between 8 and 13 ms for the three comparative devices.

Tests concerning sensitivity of touch revealed that the decrease in sensitivity is 50% lower after using the apparatus according to the invention.

Other subjective data provided by the questionnaires by the people who participated in the comparative tests confirmed the recorded data.

It was noted that all the tests carried out showed a clear improvement in the operating conditions of the percussion device which is the subject of the invention over the devices currently on the market and which do not have vibration damping between the striking mechanism and the housing.

It should also be mentioned at this point that the shape of the annular suspension seals 11 with a Z-shaped annular cross-section proved to be extremely important insofar as it makes possible effective sealing and a sufficiently resilient suspension to damp the vibrations. The replacement of these seals by complete circular section O-rings made it possible to observe a substantial reduction in the vibration damping effect.

What is claimed is:

1. In a percussion device comprising an elongate housing extending along an axis and having an axially forwardly open front end, a tool holder mounted at said open front end for slidably receiving a tool which projects axially forward from and which is mounted to slide axially and longitudinally in the tool holder, a cylinder mounted to slide axially and longitudinally inside the housing and having an axially forwardly open front end which is adjacent to the tool holder, a free piston which is mounted axially slidably in the cylinder and which extends axially through the open front end thereof, which piston acts as a percussion member for the tool, the piston forming with the cylinder a rear pressurizable compartment, drive means for alternately pressurizing and depressurizing the compartment at a given frequency to start up and maintain a series of percussions of the percussion device against the tool at the given frequency, and two resilient compression components disposed at respective ends of the housing and exerting opposing forces on the cylinder, the improvement wherein the diameter of the cylinder is selected so as to provide a circumferential clearance between the cylinder and the housing, and two respective resilient annular Z-section bearings are provided, spaced longitudinally from one another, interposed between the cylinder and the housing, and each bearing radially inward on the cylinder and radially outward on the housing to guide the cylinder coaxially in the housing and to suspend the cylinder in the housing out of contact therewith.

2. The percussion device defined in claim 1, further comprising a tubular member surrounding at least part of the length of the housing, and a vibration damping material disposed between this member and the housing.

3. The percussion device defined in claim 1 wherein the housing has a lateral compressed air supply duct and the cylinder defines between its periphery and the housing an annular space communicating with the supply duct, the cylinder having a lateral aperture communicating with the annular space for transmitting air pressure to the piston, the annular bearings being disposed at axially opposite ends of the annular space to axially close same, the cylinder being provided on opposite sides of the annular space with annular grooves in which the annular bearings are seated, each bearing having parallel limbs which rests respectively against the bottom of the annular groove in which the bearing is seated and against an internal surface of the housing.

4. A percussion device for use with a tool, the device comprising an elongate housing extending along an axis and having an axially forwardly open front end and a radially inwardly directed inner surface;

a tool holder mounted at the open front end and adapted to support the tool such that same is axially displaceable relative to the housing and projects axially forward from the tool holder;

a cylinder axially and longitudinally slidable in the housing and having an axially forwardly open front end adjacent the tool holder and an outer surface radially outwardly confronting but spaced radially inward of the inner surface of the housing;

a piston axially slidable in the cylinder and extending axially through the open front end thereof, axially operatively engageable with the tool, and forming with the cylinder a rear pressurizable compartment;

front and back compression springs axially flanking the cylinder and axially oppositely braced against the housing, whereby the cylinder is axially supported by the springs;

drive means for alternately pressurizing and depressurizing the compartment and thereby axially reciprocating the cylinder in the housing between an extreme axial forward position axially compressing the front spring while not contacting the housing and an extreme rear position compressing the rear spring while not contacting the housing; and front and back resilient annular seals spaced longitudinally from one another, interposed between the cylinder and the housing, bearing radially inward on the cylinder and radially outward on the housing, and suspending the cylinder in the housing out of contact therewith.

5. The percussion device defined in claim 4 wherein the outer surface of the cylinder has a radius of curvature smaller by about 0.2 mm than the radius of curvature of the inner surface of the housing.

6. A method of operating a compression device with a tool, the device comprising an elongate housing extending along an axis and having an axially forwardly open front end and a radially inwardly directed inner surface;

a tool holder mounted at the open front end and adapted to support the tool such that same is axially displaceable relative to the housing and projects axially forward from the tool holder;

a cylinder axially and longitudinally slidable in the housing and having an axially forwardly open front end adjacent the tool holder and an outer surface radially outwardly confronting but spaced radially inward of the inner surface of the housing;

a piston axially slidable in the cylinder and extending axially through the open front end thereof, axially operatively engageable with the tool, and forming with the cylinder a rear pressurizable compartment;

front and back compression springs axially flanking the cylinder and axially oppositely braced against the housing, whereby the cylinder is axially supported by the springs; and front and back resilient annular seals spaced longitudinally from one another, interposed between the cylinder and the housing, and bearing radially inward on the cylinder and radially outward on the housing, the method comprising the steps of alternately pressurizing and depressurizing the compartment and thereby axially reciprocating the cylinder between an extreme axial forward position axially forwardly compressing the front spring while not contacting the housing and an extreme rear position compressing the rear spring while not contacting the housing, whereby the cylinder does not axially engage the housing during such reciprocation;

synchronously but oppositely to the cylinder axially reciprocating the piston between a forward position operatively engaging the tool and a rear position out of contact with the tool; and suspending the cylinder in the housing out of contact therewith by means of the seals during axial reciprocation.

* * * * *